US005387838A

United States Patent [19]

Hirakawa et al.

[11] Patent Number: 5,387,838

[45] Date of Patent: Feb. 7, 1995

[54] FLUORESCENT DISPLAY DEVICE WITH HIGH DUTY RATIO

[75] Inventors: Haruhisa Hirakawa; Yoshihisa Tsuruoka; Eiji Sato, all of Mobara, Japan

[73] Assignee: Futaba Denshi Kogyo K.K., Mobara, Japan

[21] Appl. No.: 885,452

[22] Filed: May 19, 1992

[30] Foreign Application Priority Data

May 20, 1991 [JP] Japan ..... 3-044790[U]

[51] Int. Cl.[6] ..... H01J 63/02

[52] U.S. Cl. ..... 313/496; 313/500; 313/517; 345/47; 345/75

[58] Field of Search ..... 313/491, 496, 500, 517; 345/47, 75, 58; 359/88, 61, 54; 340/825.81

[56] References Cited

U.S. PATENT DOCUMENTS 4,303,917 12/1981 Kishino et al. ..... 313/496
4,486,749 12/1984 Kishino et al. ..... 345/75
4,881,017 11/1989 Tsuruoka ..... 313/495
5,055,744 10/1991 Tsuruoka ..... 315/169.1
5,146,356 9/1992 Carlson ..... 359/61

*Primary Examiner*—Donald J. Yusko
*Assistant Examiner*—N. D. Patel
*Attorney, Agent, or Firm*—Oblon, Spivak, McClelland, Maier & Neustadt

[57] ABSTRACT

A fluorescent display device including a laterally elongated matrix-like display section and a plurality of control electrodes arranged in juxtaposition to each other while a longitudinal direction thereof is defined in a short side direction of the display section is disclosed which is capable of increasing a duty ratio when scanning the control electrodes. A plurality of picture cells are arranged longitudinally and laterally at equal intervals, resulting in forming the matrix-like display section. A plurality of sets of picture cells in an oblique direction are connected together. The control electrodes are connected together at every predetermined interval. Thus, when the control electrodes are scanned and the anode conductors are fed with a display signal, the fluorescent display device carries out graphic display while selecting desired picture cells at a high duty ratio.

19 Claims, 2 Drawing Sheets

FLUORESCENT DISPLAY DEVICE WITH HIGH DUTY RATIO

BACKGROUND OF THE INVENTION

This invention relates to a fluorescent display device for graphic display which is adapted to display characters, numerals or the like by an elongated rectangular display section including a plurality of picture cells arranged longitudinally and laterally, and more particularly to a connection structure for such a fluorescent display device for electrically connecting the picture cells to each other.

A fluorescent display device for graphic display which includes a longitudinally or laterally elongated display section has been conventionally known in the art. The display section is formed of a plurality of longitudinally and laterally arranged picture cells into an elongated rectangular shape. For example, the display section may be formed of 24×264 picture cells arranged in a dot-like manner, resulting in carrying out display in eleven digits.

For example, a fluorescent display device of this type employs a single-matrix system to form and drive an electrode structure. In the single-matrix system, anode conductors for the picture cells of the display section are connected together in one of longitudinal and lateral directions of the display section to form a plurality of rows of picture cells parallel to each other, and a plurality of control electrodes are arranged above the display section in a manner to be perpendicular to the rows of picture cells, so that one of the rows of picture cells and control electrodes thus arranged is scanned and the other is fed with a display signal to carry out a desired selection of the picture cells.

Supposing that the display signal is supplied to the control electrodes for driving the fluorescent display device, the control electrodes are subject to static driving, resulting in a voltage being constantly applied to the control electrodes depending upon a manner of display. Unfortunately, this causes the control electrodes to be heated due to inflow of electrons thereto, leading to deformation of the control electrodes sufficient to adversely affect display. Also, this, in the worst case, causes the control electrodes to be electrically contacted with the anode conductors or other electrodes, resulting in short-circuiting. In order to avoid the problem, it has been generally carried out to scan the control electrodes and feed the rows of picture cells with the display signal.

In the conventional fluorescent display device described above, it would be considered that the control electrodes are formed into the same longitudinal dimension or length as a dimension of a long side of the display section and arranged in juxtaposition to each other in a direction of a short side of the display section. Such a construction permits the number of times at which the control electrodes are scanned to be decreased to increase a duty ratio when scanning the control electrodes. Unfortunately, this renders an arrangement of the control electrodes while stretching troublesome. In particular, this readily causes deterioration of quality of display and short-circuiting between the control electrodes and any other electrodes due to sagging and vibration of the control electrodes during the operation. Thus, in the conventional fluorescent display device, it has been generally carried out that the control electrodes are formed into the same length as a dimension of the short side of the display section and arranged in juxtaposition to each other in a direction of the long side of the display section, although such an arrangement causes a decrease in duty ratio.

Also, in the conventional fluorescent display device, filamentary cathodes are stretchedly arranged in the long side direction of the display section in order to ensure enlargement of a display area, simplification of wiring arrangement, reduction in energy consumption and the like. Supposing that the control electrodes are arranged in parallel with the filamentary cathodes under such conditions that the filamentary cathodes are arranged in the long side direction of the display section, scanning of the control electrodes causes positional relationships between the filamentary cathodes and the control electrodes to which a voltage is applied to be varied, leading to a failure in driving of the fluorescent display device under the same conditions. This is another reason that the control electrodes are arranged in the long side direction of the display direction.

For the reasons noted above, in the conventional fluorescent display device for graphic display which includes the elongated display section, the control electrodes are formed into the same length as the short side of the display section and arranged in the long side direction of the display section in a manner to be spaced from each other at predetermined intervals. The anode conductors for the picture cells of the display section are arranged perpendicular to the longitudinal direction of the control electrodes and connected together in the long side direction of the display section. The control electrodes are scanned and each row of anode conductors perpendicular to the control electrodes are supplied with a display signal, resulting in the desired display being obtained.

Unfortunately, the conventional fluorescent display device constructed as described above has a disadvantage of being increased in the number of control electrodes to be scanned, resulting in being decreased in duty ratio. For example, supposing that the display section is formed of 24×264 picture cells arranged in a dot-like manner, the duty ratio is decreased to a level as small as 1/264, so that the device fails to exhibit sufficient luminance unless a voltage applied to the anode conductors is increased. Unfortunately, an increase in driving voltage causes a driving IC used to be expensive and promotes deterioration of a phosphor layer.

Alternatively, a multi-matrix system may be used for constructing and driving the fluorescent display device including the elongated display section. The multi-matrix system permits each of the control electrodes to cover two rows of picture cells in the short side direction of the display section and the anode conductors to be connected together for each two or three picture cells. The system permits the duty ratio to be doubled, to thereby reduce the number of ICs required for driving the control electrodes to half, however, it causes the number of ICs necessary to control the anode conductors to be three or four times. Also, it causes the wiring arrangement to be complicated, resulting in application of the multi-matrix system to the picture cells which are arranged at small intervals being hard.

SUMMARY OF THE INVENTION

The present invention has been made in view of the foregoing disadvantage of the prior art.

Accordingly, it is an object of the present invention to provide a fluorescent display device including an elongated matrix-like display section and a plurality of control electrodes arranged in parallel with each other and having a longitudinal direction aligned with a short side of the display section which is capable of increasing a duty ratio when scanning the control electrodes.

In accordance with the present invention, a fluorescent display device is provided. The fluorescent display device includes a display section including picture cells arranged in a rectangular manner in two directions perpendicular to each other so that the number of picture cells arranged in a long side direction of the display section is larger than that of picture cells arranged in a short side direction thereof, a plurality of control electrodes arranged in juxtaposition to each other above the display section in the long side direction of the display device while a longitudinal direction thereof is defined in the short side direction of the display section and filamentary cathodes arranged in parallel to the longitudinal direction of the control electrodes above the control electrodes. The picture cells are connected together in an oblique direction across the above-described two directions, the control electrodes are connected together at every predetermined interval, and the control electrodes are scanned and the picture cells are fed with a display signal.

The present invention thus constructed permits a duty ratio when scanning the control electrodes to be increased as compared with scanning of the control electrodes one by one.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

Now, a fluorescent display device according to the present invention will be described hereinafter with reference to the accompanying drawings.

The present invention is not concerned with a general construction of a fluorescent display device which is widely known in the art, therefore, the following description will be directed to only relationships between wiring patterns of anode conductors and control electrodes.

Figure 1:
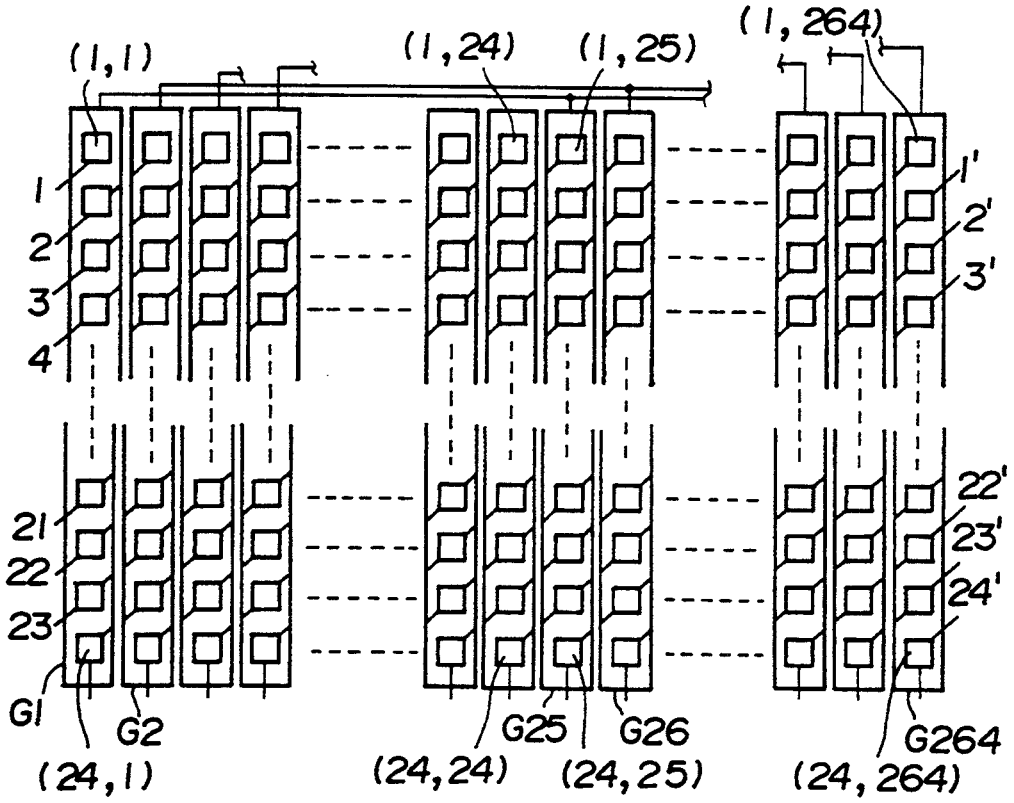
FIG. 1 is a schematic view showing a manner of connection of electrodes in an embodiment of a fluorescent display according to the present invention.

Referring first to FIG. 1 showing an embodiment of a fluorescent display device according to the present invention, a fluorescent display device of the illustrated embodiment is constructed so as to have a display section of which the number of picture cells is 24×264. More specifically, it is adapted to carry out graphic display wherein, for example, characters and/or numerals formed by picture cells of 24×24 in number are displayed in eleven digits. In FIG. 1, designations (1, 1)–(24, 264) indicate positions of pictures cells and therefore anode conductors.

A plurality of control electrodes G are formed into the same longitudinal dimension or length as the dimension of a short side of the display section and arranged in juxtaposition with each other in a long side direction of the display section in a manner to correspond to the respective rows of picture cells in the short side direction of the display section. Thus, the number of control electrodes is 264 (G1 to G264). Each two of the control electrodes thus arranged are connected at every twenty-fourth interval or with each twenty-four control electrodes being interposed therebetween. For example, the first and twenty-fifth control electrodes are connected together. This results in the control electrodes being grouped into twenty-four sets each comprising eleven control electrodes. The control electrodes G each are formed into a flat-plate like electrode provided with a mesh-like openings.

The picture cells facing the control electrodes each comprise an anode conductor and a phosphor layer deposited on an upper surface of the anode conductor. The picture cells thus formed are arranged so as to constitute the elongated display section of 264 dots and each of the anode conductors of the picture cells is connected to the upper-right and lower-left anode conductors adjacent thereto in an oblique direction. The picture cells of two rows positioned on both ends of the display section so as to extend in the short side direction thereof are connected together or common to each other as indicated at 1 and 1', 2 and 2',—in FIG. 1, respectively, resulting in all or twenty-four anode conductors being connected together.

Thus, the anode conductors of the picture cells are connected together in the oblique direction and the control electrodes are connected together at every twenty-fourth interval, resulting in being grouped or divided into twenty-four sets. Such an arrangement permits a plurality of picture cells corresponding to each set of control electrodes to belong to a electrically different set.

In the fluorescent display device of the illustrated embodiment constructed as described above, scanning of the control electrodes and feeding of a display signal to the anode conductors permit the picture cells to be selected as desired, resulting in a desired display being carried out. The control electrodes which are to be scanned are grouped into twenty-four sets, so that a duty ratio in operation of the control electrodes may be 1/24. Thus, it will be noted that the illustrated embodiment substantially increases the duty ratio, as compared with the conventional fluorescent display device of the single-matrix driving system which causes it to be 1/264. Also, this permits the picture cells to exhibit sufficient luminance even at a low voltage. Also, the fluorescent display device significantly increases the duty ratio as compared with the conventional fluorescent display device of the device multi-matrix driving type.

In connection with ICs for driving, the conventional fluorescent display device requires 288 bits and more specifically 24 bits for driving the anode conductors (the number of picture cells in the short side direction of the display section) and 264 bits for driving the control electrodes (the number of picture cells in the long side direction). Whereas, the illustrated embodiment likewise requires 288 bits (sum of picture cells in both long and short side directions) which are the same as in the conventional fluorescent display device. More specifically, the control electrodes are grouped into twenty-four sets equal in number to the picture cells in the short side direction of the display section, so that 24 bits are required for driving the control electrodes; and the anode conductors are connected together in the same number as the picture cells in the short side direction, so that 264 bits are required for driving the anode conductors.

The embodiment shown in FIG. 1 may be constructed in such a manner that the anode conductors are vertically divided into two groups, which are then commonly connected in an oblique direction, respectively. Such a construction permits connection of the control electrodes to be carried out at every twelfth interval, so that the duty ratio may be ½, to thereby be twice that in FIG. 1. In this instance, the number of bits required for driving the anode conductors is twice and the number of bits for driving the control electrodes is ½.

Figure 2:
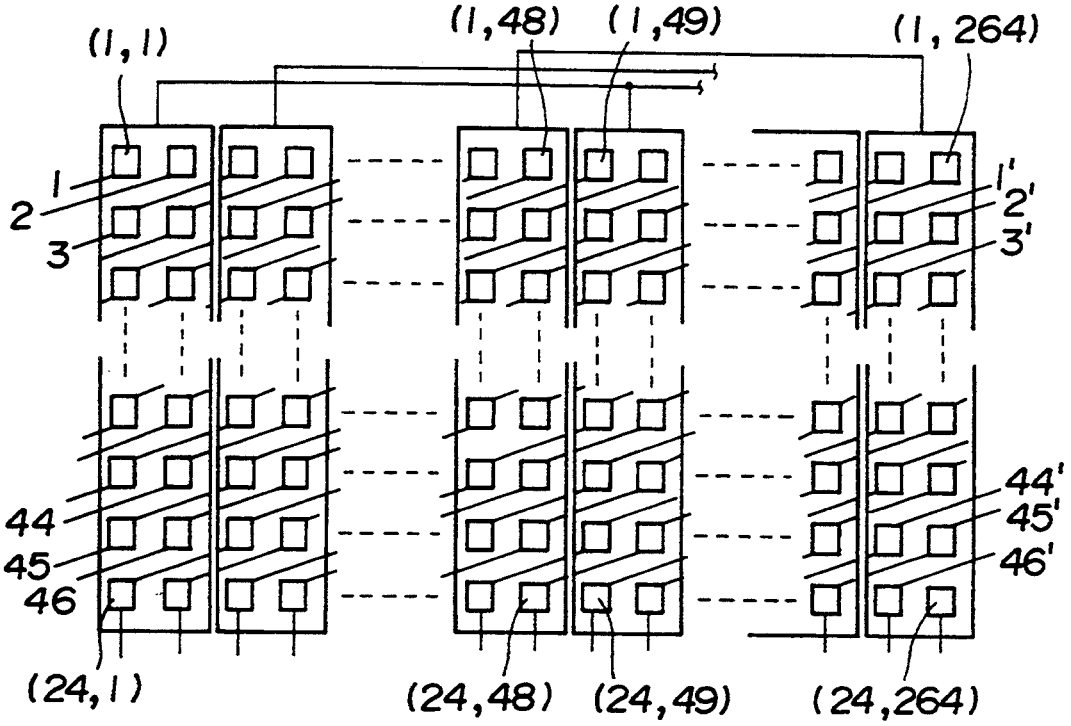
FIG. 2 is a schematic view showing a manner of connection of electrodes in another embodiment of a fluorescent display according to the present invention.

FIG. 2 shows another embodiment of a fluorescent display device according to the present invention, wherein a display section likewise includes a plurality of picture cells longitudinally and laterally arranged in the same pattern as those in the embodiment shown in FIG. 1. Anode conductors for the picture cells of the display section are connected together at every second interval in a long side direction of the display section and connected to upper right and lower left anode conductors in sets adjacent thereto in a short side direction of the display section in turn. A plurality of control electrodes each are arranged in a manner to cover or extend over each adjacent two rows of picture cells juxtaposed to each other in the long side direction of the display section so as to be parallel in the short side direction of the display section. The control electrodes are connected together at every twenty-fourth interval or with each twenty-three control electrodes being interposed therebetween and the number of picture cells in the short side direction of the display section is twenty-four. More specifically, for example, the control electrode corresponding to two rows of picture cells (1, 1) and (1, 2) and that corresponding to two rows of picture cells (1, 49) and (1, 50) are connected together. In two rows of picture cells on each of both short sides of the display section, wirings 1 to 48 and wirings 1' to 48' are connected together, respectively.

The construction described above with reference to FIG. 2 permits the number of control electrodes to be half, as compared with that shown in FIG. 1, although the former causes arrangement of the wirings for the anode conductors to be more complicated while keeping the duty ratio and the number of bits of driving ICs unchanged. Further, it decreases the number of parts and increases strength of the control electrodes.

In each of the embodiments shown in FIGS. 1 and 2, the control electrodes each are formed into a shape like a flat plate which is provided with a mesh-like opening. However, they may be formed into a wire-like electrode. Use of a wire-like electrode for each of the control electrodes facilitates application of tension to the control electrode and prevents sagging of the control electrodes. Also, for example, arrangement of wires one by one between the picture cells causes the number of bits to be larger by one than the number of picture cells due to a difference in driving direction, however, it accomplishes control in substantially the same manner as in the embodiments described above. Also, use of the wire-like electrode permits a pitch between the picture cells to be reduced.

The wirings for the anode conductors may be connected together in an upper left direction. In the embodiments described above, the anode conductors at each of both ends are connected common to each other or together. Alternatively, the anode conductors may be led out without being connected together. Such a connection facilitates arrangement of the wirings although it increases the number of wirings to be led out.

Figure 3:
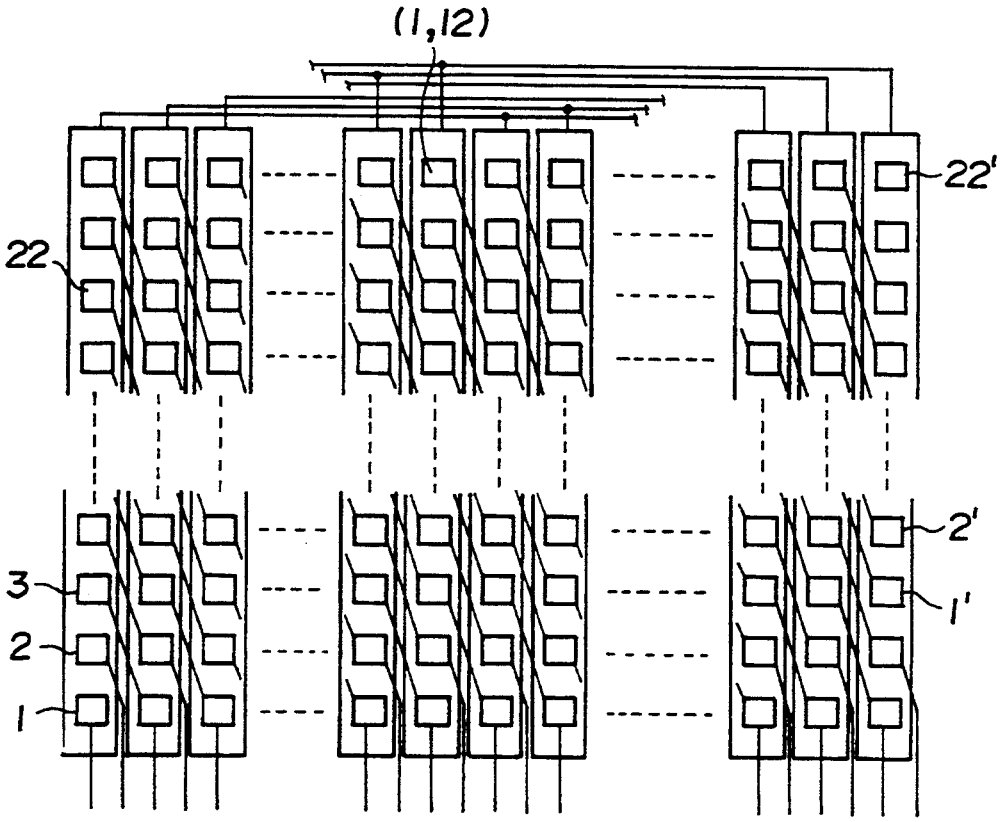
FIG. 3 is a schematic view showing a manner of connection of electrodes in a further embodiment of a fluorescent display according to the present invention.

The anode conductors and control electrodes may be connected in such a manner as shown in FIG. 3, which shows a further embodiment of a fluorescent display device according to the present invention. In the embodiment of FIG. 3, picture cells arranged in rows in a short side direction of a display section are connected to each other in an oblique direction in such a manner that each of the picture cells is connected to a lower second picture cell of the next row on the right side and an upper second one of the next row on the left side. Picture cells arranged at each of both upper and lower ends of the display section in a long side direction thereof are connected together as in the embodiments described above. More specifically, picture cells located at positions deviated by each two picture cells in the short side direction, for example, as indicated at 1 and 1', 2 and 2',—in FIG. 3 are connected together. The control electrodes are constructed in the same manner as the embodiment of FIG. 1 and connected together at every thirteenth interval. This results in the number of terminals of the anode conductors being $264\times2$, however, the duty ratio is caused to be 1/12. The number of bits for ICs for driving is $528+12=540$.

As can be seen from the foregoing, the fluorescent display device of the present invention which includes the laterally elongated display section is so constructed that the anode conductors for the picture cells are connected together in an oblique direction and a plurality of control electrodes which are arranged in juxtaposition to each other while the longitudinal direction thereof is defined in the short side direction of the display section are connected together at every predetermined interval. Thus, when the control electrodes are scanned and the anode conductors are fed with a display signal, the fluorescent display device of the present invention carries out graphic display while selecting desired picture cells at a high duty ratio as compared with the prior art.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise as specifically described.

What is claimed as new and desired to be secured by Letters Patent of the United States is:

1. A fluorescent display device comprising:

a display section including a plurality of picture cells arranged in a rectangular manner in two directions perpendicular to each other so that the number of picture cells arranged in a long side direction of said display section is larger than that of picture cells arranged in a short side direction thereof;

a plurality of control electrodes arranged in juxtaposition to each other above said display section in the long side direction of said display device while a longitudinal direction thereof is defined in the short side direction of said display section; and filamentary cathodes arranged in parallel to said longitudinal direction above said control electrodes;

said picture cells being connected together in an oblique direction across said two directions;

said control electrodes being connected together at a predetermined interval;

said control electrodes being scanned and said picture cells being fed with a display signal.

2. A fluorescent display device as defined in claim 1, wherein said picture cells each comprise an anode conductor and a phosphor layer deposited on an upper surface of said anode conductor.

3. A fluorescent display device as defined in claim 2, wherein said anode conductors are connected together in an upper-left direction.

4. A fluorescent display device as defined in claim 1, wherein said control electrodes each are formed into a flat-plate like electrode provided with mesh-like openings.

5. A fluorescent display device as defined in claim 1, wherein said display section is formed of 24×264 picture cells arranged in a dot-like manner, each of said anode conductors of said picture cells is connected to the upper-right and lower-left anode conductors adjacent thereto in an oblique direction, and each two of said control electrode are connected at every twenty-fourth interval or with each twenty-four control electrodes being interpassed therebetween, resulting in said control electrodes being grouped or divided into twenty-four sets each comprising eleven control electrodes.

6. A fluorescent display device as defined in claim 1, wherein said anode conductors are vertically divided into two groups, which are then commonly connected in an oblique direction, respectively.

7. A fluorescent display device comprising:

a display section including a plurality of picture cells, each comprising an anode conductor, arranged in a rectangular manner in two directions perpendicular to each other so that the number of picture cells arranged in a long side direction of said display section is larger than that of picture cells arranged in a short side direction thereof;

a plurality of control electrodes arranged in juxtaposition to each other above said display section in the long side direction of said display device while a longitudinal direction thereof is defined in the short side direction of said display section; and filamentary cathodes arranged in parallel to said longitudinal direction above said control electrodes;

said picture cells being connected together in an oblique direction across said two directions;

said control electrodes being connected together at a predetermined interval;

said control electrodes being scanned and said picture cells being fed with a display signal; and wherein said anode conductors for said picture cells of said display section are connected together at every second interval and connected to upper-right and lower-left anode conductors in sets adjacent thereto in turn.

8. A fluorescent display device as defined in claim 7, wherein said picture cells each further comprise a phosphor layer deposited on an upper surface of said anode conductor.

9. A fluorescent display device as defined in claim 7, wherein said control electrodes each are formed into a flat-plate like electrode provided with mesh-like openings.

10. A fluorescent display device as defined in claim 7, wherein said display section is formed of 24×264 picture cells arranged in a dot-like manner, each two of said control electrode are connected at every twenty-fourth interval or with each twenty-four control electrodes being interpassed therebetween, resulting in said control electrodes being grouped or divided into twenty-four sets each comprising eleven control electrodes.

11. A fluorescent display device as defined in claim 7, wherein said anode conductors are vertically divided into two groups, which are then commonly connected in an oblique direction, respectively.

12. A fluorescent display device as defined in claim 7, wherein said anode conductors are connected together in an upper-left direction.

13. A fluorescent display device as defined in claim 7, wherein said picture cells are connected to each other in an oblique direction in such a manner that each of said picture cells is connected to a lower second picture cell of the next row on the right side and an upper second one of the next row on the left side.

14. A fluorescent display device comprising:

a display section including a plurality of picture cells arranged in a rectangular manner in two directions perpendicular to each other so that the number of picture cells arranged in a long side direction of said display section is larger than that of picture cells arranged in a short side direction thereof;

a plurality of control electrodes arranged in juxtaposition to each other above said display section in the long side direction of said display device while a longitudinal direction thereof is defined in the short side direction of said display section; and filamentary cathodes arranged in parallel to said longitudinal direction above said control electrodes;

said picture cells being connected together in an oblique direction across said two directions;

said control electrodes being connected together at a predetermined interval;

said control electrodes being scanned and said picture cells being fed with a display signal; and wherein said picture cells are connected to each other in an oblique direction in such a manner that each of said picture cells is connected to a lower second picture cell of the next row on the right side and an upper second one of the next row on the left side.

15. A fluorescent display device as defined in claim 14, wherein said picture cells each comprise an anode conductor and a phosphor layer deposited on an upper surface of said anode conductor.

16. A fluorescent display device as defined in claim 15, wherein said anode conductors are connected together in an upper-left direction.

17. A fluorescent display device as defined in claim 14, wherein said control electrodes each are formed into a flat-plate like electrode provided with mesh-like openings.

18. A fluorescent display device as defined in claim 14, wherein said display section is formed of 24×264 picture cells arranged in a dot-like manner, each of said anode conductors of said picture cells is connected to the upper-right and lower-left anode conductors adjacent thereto in an oblique direction, and each two of said control electrode are connected at every twenty-fourth interval or with each twenty-four control electrodes being interpassed therebetween, resulting in said control electrodes being grouped or divided into twenty-four sets each comprising eleven control electrodes.

19. A fluorescent display device as defined in claim 14, wherein said anode conductors are vertically divided into two groups, which are then commonly connected in an oblique direction, respectively.

* * * * *